US005642663A

United States Patent [19]

Hara

[11] Patent Number: 5,642,663

[45] **Date of Patent: *Jul. 1, 1997**

[54] APPARATUS FOR CONTROLLING A LINKAGE DRIVE SECTION IN A STENCIL PRINTING MACHINE

[75] Inventor: Yoshikazu Hara, Tokyo, Japan

[73] Assignee: Riso Kagaku Corporation, Tokyo, Japan

[ * ] Notice: The term of this patent shall not extend beyond the expiration date of Pat. No. 5,553,537.

[21] Appl. No.: 599,356

[22] Filed: Feb. 9, 1996

Related U.S. Application Data

[63] Continuation of Ser. No. 402,332, Mar. 10, 1995, Pat. No. 5,553,537.

[30] Foreign Application Priority Data

Mar. 10, 1994 [JP] Japan ..... 6-40098

[51] Int. Cl.[6] ..... B41L 13/04

[52] U.S. Cl. ..... 101/116; 101/248

[58] Field of Search ..... 101/114, 116–119, 101/120, 129, 248, 481, 485, 486, DIG. 36

[56] References Cited

U.S. PATENT DOCUMENTS

| | | | |
|---|---|---|---|
| 3,572,240 | 3/1971 | Bohm | 101/116 |
| 4,214,528 | 7/1980 | Mirow | 101/248 |
| 4,484,522 | 11/1984 | Simeth | 101/248 |
| 5,327,826 | 7/1994 | Rodi | 101/486 |
| 5,507,225 | 4/1996 | Noguchi et al. | 101/116 |

FOREIGN PATENT DOCUMENTS

| | | | |
|---|---|---|---|
| 52781 | 6/1982 | European Pat. Off. | 101/119 |
| 0517480 | 12/1992 | European Pat. Off. . | |
| 40179 | 2/1986 | Japan | 101/116 |
| 483403 | 1/1937 | United Kingdom . | |

OTHER PUBLICATIONS

*Patent Abstracts of Japan*, vol. 8, No. 100 (M–295) (1537) May 11, 1994 (JP–A–59 012894).

*Primary Examiner*—Stephen R. Funk

*Attorney, Agent, or Firm*—Sughrue, Mion, Zinn, Macpeak & Seas

[57] ABSTRACT

In a stencil printing machine, when a printing drum is set at its operating position in the direction of its axis, a drum switch is turned on, and a locking piece is engaged with a groove formed in an engaging rod integral with the printing drum, so that a lock switch is also turned on. In the case where the printing drum pushed into the printing machine is not at the operating position, the drum presence/absence switch is turned on, and the locking piece is not engaged with the groove, so that the lock switch is off. In this case, the locking piece is reciprocated a predetermined distance in both directions. As a result, the locking piece is engaged with the groove of the engaging rod; that is, the printing drum is moved axially to the operating position.

4 Claims, 10 Drawing Sheets

APPARATUS FOR CONTROLLING A LINKAGE DRIVE SECTION IN A STENCIL PRINTING MACHINE

This application is a continuation of application Ser. No. 08/402,332 filed Mar. 10, 1995, now U.S. Pat. No. 5,553,537.

BACKGROUND OF THE INVENTION

1. Field of Invention

This invention relates to the technical field of mimeograph, and more particularly to a method of controlling a linkage drive section in a stencil printing machine to set a printing drum in place in which the position of a print image can be adjusted in a horizontal direction with ease. In this specification, the term "horizontal direction" is intended to mean "a direction which is in parallel with the central axis of the printing drum"; and the term "horizontal position" is intended to mean "a position along the direction thus defined".

2. Description of Related Art

In a conventional rotary stencil printing machine with a printing drum, the printing drum is set at a predetermined position in the direction of its axis in the printing machine frame and rotated around its central axis. In the machine, adjustment of the horizontal position of a print image can be achieved by suitably shifting the position of the mimeographic stencil paper on the printing drum in the direction of the axis of the printing drum before it is wound on the printing drum. Alternatively, by moving the sheet supplying device in the direction of the axis of the printing drum, the horizontal position of the print image can be adjusted at all times, not only in the case where the stencil paper is not wound on the printing drum yet but also in the case where it is wound on it.

In moving a mimeographic stencil paper or a printing sheet, which is rectangular and has two short sides extended in the direction of movement and two long sides which are perpendicular to the short sides, over the printing drum along the axis of the latter, the stencil paper or printing sheet must be parallel-moved in the direction of the short sides with high accuracy. In order to make this movement delicate and accurate thereby to permit the fine adjustment in horizontal position of the print image, means for horizontally moving a stencil paper feeding device adapted to feed a stencil paper to the printing drum and a sheet supplying device adapted to supply printing sheets to the printing drum should have: guide means which use a pair of parallel guide rails laid in the lateral direction of the stencil paper or printing sheet to guide the stencil paper feeding device or the sheet supplying device accurately parallel at least two positions spaced from each other in the longitudinal direction of the stencil paper or printing sheet; and fine drive means for giving feeding actions to the stencil paper feeding device or the sheet supplying device along the guide means for the same distance at the same speed.

As is apparent from the above description, in the case where, with respect to the printing drum which has been fixed in the axis direction, the stencil paper or printing sheet is moved along the axis of the printing drum to adjust the horizontal position of the print image, it is necessary to provide considerably intricate means.

SUMMARY OF THE INVENTION

In view of this fact, an object of the invention is to provide a stencil printing machine which is so improved that the horizontal position of a print image can be adjusted readily and accurately with simple means, and to make it possible to positively set the printing drum at the operating position in the stencil printing machine.

The foregoing object of the invention has been achieved by the provision of a method of controlling a linkage drive section in a stencil printing machine which comprises: a printing drum; a printing machine frame; a printing drum holding device which rotatably supports the printing drum, and which is suspended from the printing machine frame in such a manner that the device is movable along the axis of the printing drum to move the printing drum between an operating position in the printing machine and a draw-out position outside the printing machine; and print image position adjusting means for finely adjusting the position of the printing drum in the axial direction of the printing drum with respect to the printing machine frame, the print image position adjusting means having a first coupling element provided on the side of the printing drum holding device, a second coupling element provided on the side of the printing machine frame, and the linkage drive section provided on the side of the second coupling element for driving the second coupling element along the axial direction of the printing drum with respect to the printing machine frame, one of the first and second coupling elements having a lateral groove which is extended perpendicular to the axial direction of the printing drum, while the other being provided with a movable locking piece which is selectively engaged with the lateral groove to prevent the relative movement of the first and second coupling elements in the axial direction of the printing drum, the method comprising the steps of:

(a) detecting whether or not the printing drum is located near a standard position with respect to the printing machine frame when the printing drum is set in the printing machine frame;

(b) detecting whether or not the locking piece is engaged with the lateral groove;

(c) moving the second coupling element a first distance in a first direction in parallel with the axial direction of the printing drum when it is detected that the printing drum is located near the standard position and that the locking piece is not engaged with the lateral groove; and (d) after the step (c), moving the second coupling element a second distance in a second direction opposite to the first direction.

DETAILED DESCRIPTION OF THE PREFERRED EMBODIMENTS

The invention will be described with reference to its preferred embodiment shown in the accompanying drawings.

Figure 1:
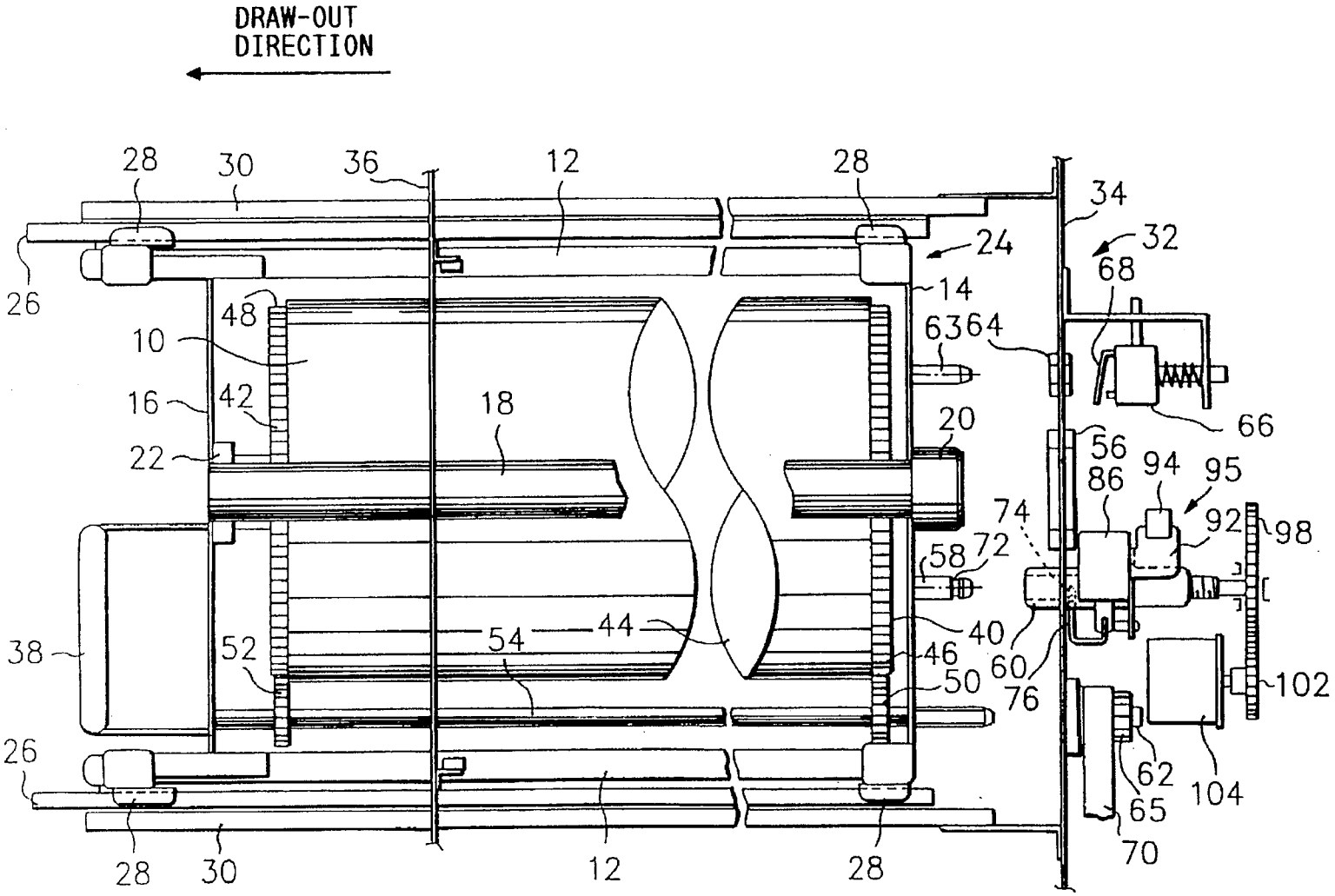
FIG. 1 is a plan view showing essential components of a stencil printing machine according to the invention.
Figure 2:
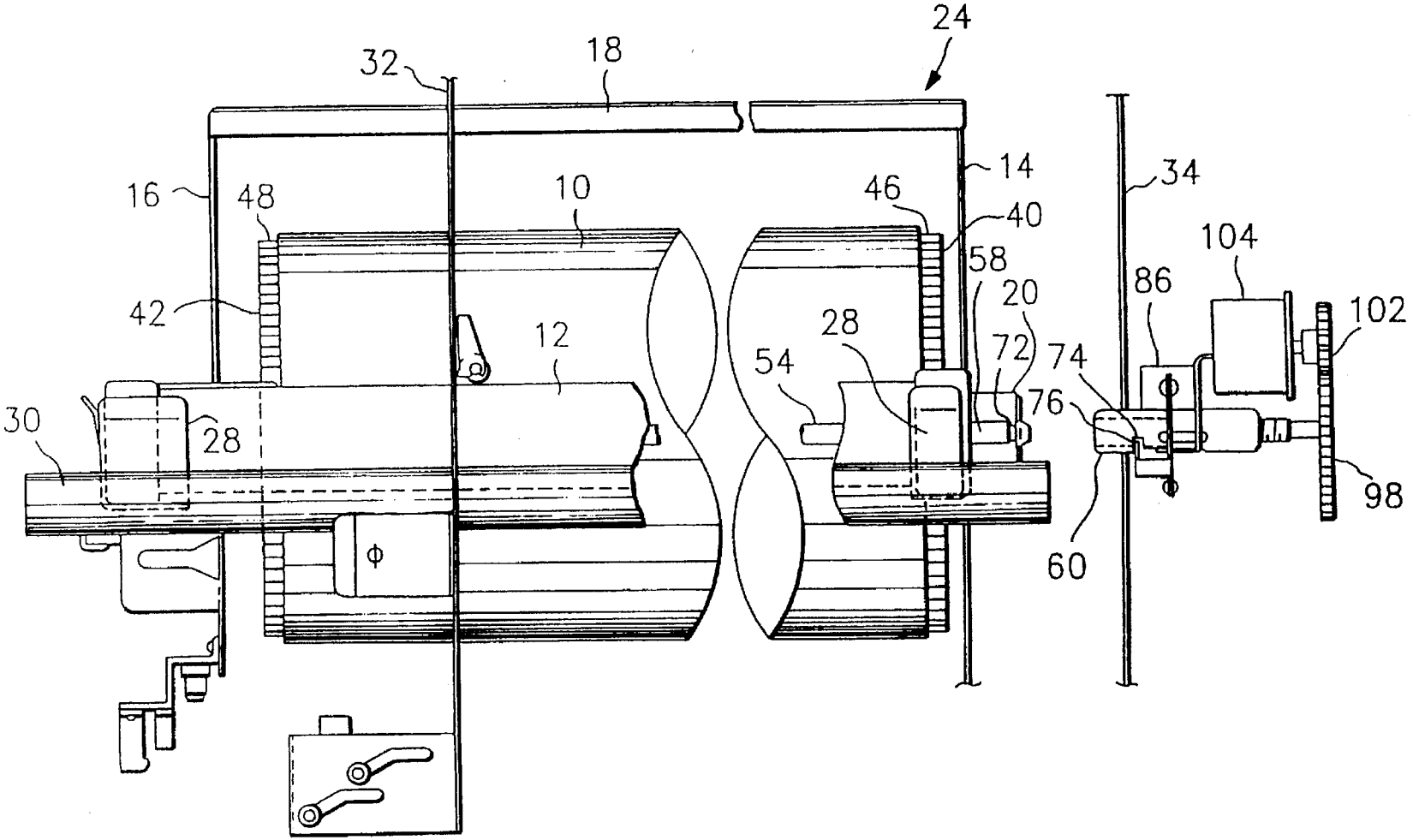
FIG. 2 is a side view showing parts of the machine illustrated in FIG. 1.
Figure 3:
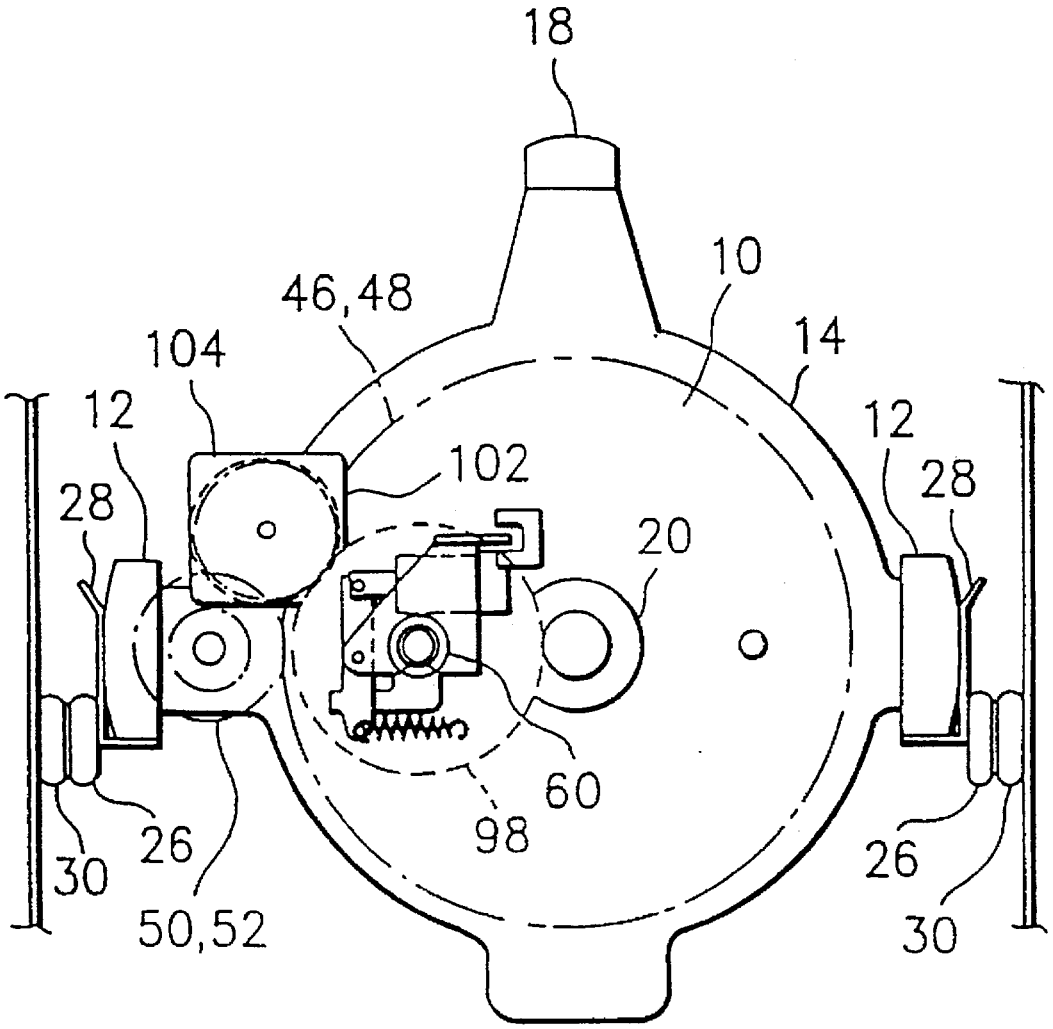
FIG. 3 is an end view showing parts of the machine illustrated in FIG. 1.
Figure 4:
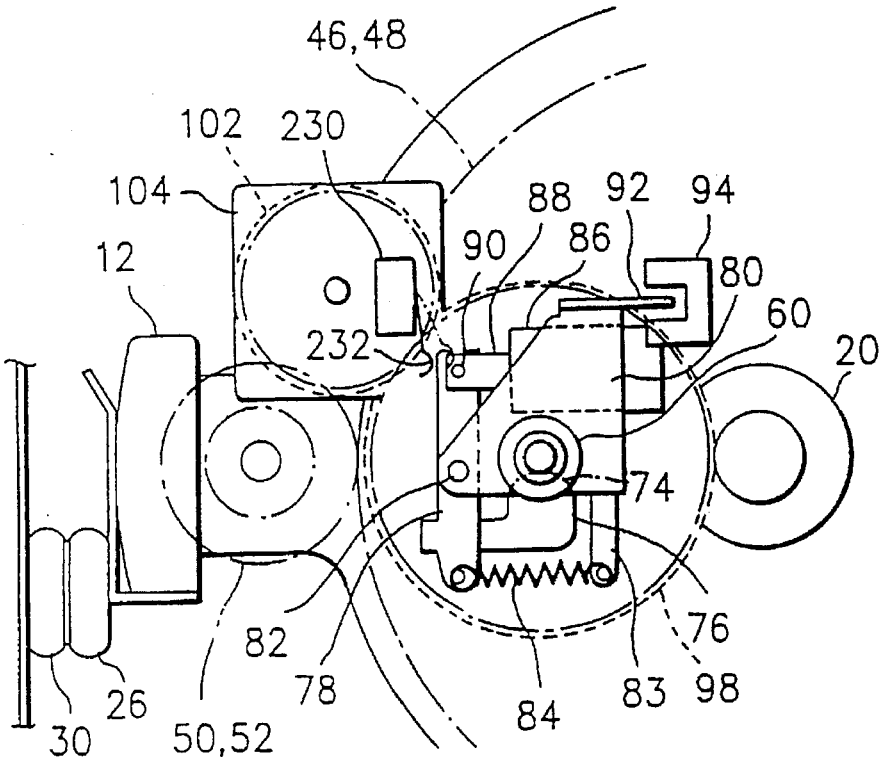
FIG. 4 is an enlarged diagram of part of FIG. 3.
Figure 5:
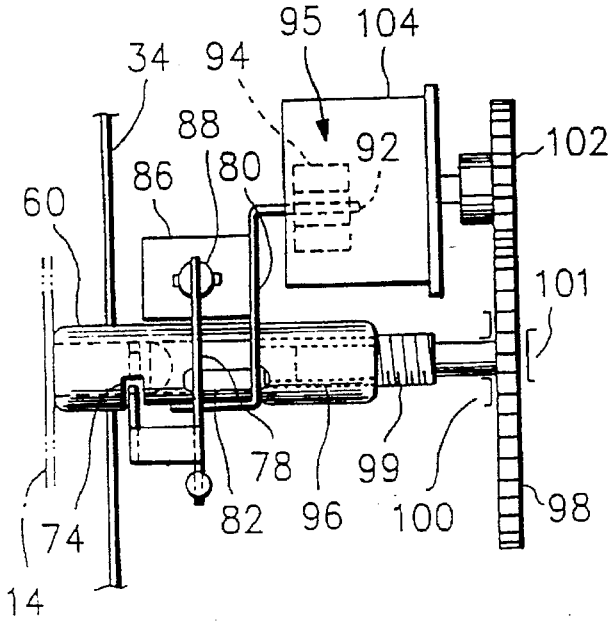
FIG. 5 is a side view corresponding to FIG. 4.

FIGS. 1, 2 and 3 are a plan view, a side view and an end view, respectively, showing a stencil printing machine of the invention, which comprises: a printing drum; a printing drum holding device which supports the printing drum; means for suspending the printing drum holding device from a printing machine frame in such a manner that the latter is movable in the axial direction of the printing drum; and print image position adjusting means which acts on the printing drum holding device and the printing machine frame to finely adjust the horizontal position of the printing drum with respect to the printing machine frame which is located at the operating position. FIG. 4 is an enlarged end view of a part of the structure shown in FIG. 3, to show it in more detail. FIG. 5 is a side view of the components shown in FIG. 4, corresponding to an enlarged diagram of a part of FIG. 2. In FIGS. 1 through 5, like parts are designated by like reference numerals or characters.

In those figures, reference numeral 10 designates a printing drum; and 24, a printing drum holding device including a pair of side frames 12, end boards 14 and 16, a lifting handle 18, and bearings 20 and 22. The printing drum 10 is supported by the printing drum holding device 24 in such a manner that, with the aid of the bearings 20 and 22, it is not movable in its axial direction, and is freely rotatable around the central axis.

The printing drum holding device 24 is suspended through a pair of side frames 12. That is, the side frames 12 are suspended from a pair of intermediate movable rails 26 through metal fittings 28 which are fixedly secured to the intermediate movable rails 26. The intermediate movable rails 26 are supported by a pair of stationary rails 30, respectively, in such a manner that the intermediate movable rails 26 are movable along the stationary rails 30. The stationary rails 30 are supported by side boards 34 and 36 which are parts of a printing machine frame 32.

In the printing drum holding device 24, a draw-out handle 38 is secured to the end board 16. That is, the operator can readily move the device 24 in the axial direction of the printing drum by using the draw-out handle 38.

As shown in FIGS. 1 and 2, the printing drum holding device 24 is located slightly away from its rightmost position inside the printing machine frame 32 where the printing drum 10 is at the operating position of the printing machine; in other words, the device 24 is slightly shifted to the left, or towards a draw-out position, from the rightmost position. When the printing drum holding device 24 is further moved left with respect to the printing machine frame 32, then it is completely moved out of the side board 36 of the printing machine. Under this condition, the operator pulls up the lifting handle 18 by hand to disengage the pair of side frames 12 from the suspending metal fittings 28 secured to the intermediate movable rails 26. As a result, the printing drum holding device 24 together with the printing drum 10 is completely removed from the printing machine.

The printing drum 10 includes: a pair of disk members 40 and 42 provided at both ends as viewed in the axial direction of the printing drop; a cross-bar (not shown) which is extended in parallel with the axis of the printing drum so that the disk members 40 and 42 are coupled through the cross-bar to each other; and a flexible rectangular porous sheet 44 which is wound on the disk members 40 and 42 such that the porous sheet 44 is cylindrically wound around the outer cylindrical surfaces of the disk members 40 and 42 with its one edge secured to the cross-bar (which may be integral with the disk members 40 and 42). The disk members 40 and 42 have gears 46 and 48 formed in their outer peripheries, respectively. The gears 46 and 48 are engaged with pinions 50 and 52, respectively, which are mounted on a common rotary shaft 54. Hence, as the rotary shaft 54 turns, the gears 46 and 48 are turned through the pinion gears 50 and 52, so that the printing drum 10 is uniformly turned As a whole without twisting the cylinder made of the flexible porous sheet 44.

When the printing drum holding device 24 positioned as shown in FIGS. 1 and 2 is pushed right (in the figure) with respect to the printing machine frame 32, various components concerning it operates as follows: The bearing 20 is fitted in an annular bearing support 56 provided on the side board 34 of the printing machine frame 32. An engaging rod 58 (serving as a first coupling element) protruded from the end board 14 of the printing drum holding device 24 in such a manner that the engaging rod 58, which, is in parallel with the central axis of the printing drum 10, is fitted in a socket 60 (serving as a second coupling element) which is provided in alignment with the engaging rod 58. The end portion of the rotary shaft 54 of the pinions 52 which has spline keys is engaged with a drive shaft 62 having spline keyways in correspondence to the spline keys. A contact rod 63 protruded from the end board 14 in such a manner that the contact rod 63 is parallel with the central axis of the printing drum 10 is passed through an annular member 64 provided on the side board 34 in such a manner that it is in alignment with the contact rod 63, thus reaching the contact 68 of a drum presence/absence switch 66. The switch 66 detects whether or not the printing drum 10, supported by the printing drum holding device 24, is located near its operating position in the printing machine. When the printing drum 10 is positioned within one millimeter (1 mm) of its operating position in the direction of the axis of the printing drum 10, the drum presence/absence switch 66 is activated determining the presence (ON) of the printing drum 10. The aforementioned drive shaft 62 has a pulley 65, and is driven by an endless belt 70 laid over the pulley 65. The rotation of the drive shaft 62 is transmitted through the rotary shaft 54 to the pinions 50 and 52, so that the printing drum 10 is turned through the gears of the disk members 40 and 42 thereof.

The engaging rod 58 has an annular groove 72 near the end. The socket 60 has a lateral groove 74 which is aligned with the annular groove 72 when the engaging rod 58 is fully inserted into the socket 60. A locking piece 76 is provided in the lateral groove 74. When the engaging rod 58 is fully inserted into the socket 60, the end portion of the locking piece 76 is engaged with the annular groove 72 so that the engaging rod 58 and the socket 60 are positively coupled to each other, and their axial movement is inhibited. As shown in FIGS. 4 and 5, the locking piece 76 is supported by a link 78. The link 78 is supported through a pivot shaft 82 on a bracket 80 which is secured to the above-described socket 60. A tension coil spring 84 is connected between one end of the link 78 and one end of an arm 83 extended from the bracket 80, so that the link 78 is urged counterclockwise about the pivot shaft 82 by the tension coil spring 84 as viewed in FIG. 4, whereby the locking piece 76 is so urged that its end portion is pushed into the lateral groove 74. The other end of the link 78 is coupled through a shaft 90 to the operating piece 88 of a solenoid 86 mounted on the socket 60. When the solenoid 86 is energized, the link 78 is turned clockwise about the shaft 82 against the elastic force of the tension spring 84, so that the end portion of the locking piece 76 is disengaged from the lateral groove 74; that is, the engaging rod 58 is axially disengaged from the socket 60.

The bracket 80 has a tongue piece 92 at one end which cooperates with an optical sensor 94 fixedly provided on the side of the printing machine frame 32. That is, the tongue piece 92 and the optical sensor 94 form standard position detecting means 95 which detects whether or not the position of the socket 60 with respect to the printing machine frame 32 in the axial direction is a standard position. That is, the standard position detecting means is adapted to detect the standard position of the socket 60 with respect to the printing machine frame 32. The socket 60 together with the bracket 80 and the solenoid 86, which are mounted the socket 60, can be moved in the axial direction by guide means (not shown) without being inclined about the central axis.

The socket 60 has a threaded hole 96 in one end portion which is opposite to the other end portion which is engaged with the engaging rod 58. The threaded hole 96 is engaged with a threaded shaft 99 which is integral with a gear 98. The threaded shaft 99 with the gear 98 is supported by bearing means 100 and 101 in such a manner that the threaded shaft 99 with the gear 98 is rotatable but not movable in the axial direction. The gear 98 is engaged with a gear 102, so that the gear 98 is driven by the gear 102. The gear 102 is driven by a pulse motor 104. The pulse motor 104, the gears 102 and 98, and the threaded shaft 99 form a linkage drive section which drives the socket 60 along the axis of the printing drum with respect to the printing machine frame. As shown in FIG. 4, a lock switch 230 having a detecting piece 232 is provided beside the link 78. It is determined from the contact of the link 78 with the detecting piece 232 whether or not the locking piece 76 is engaged with the lateral groove 74. That is, when the position of the link 78 with respect to the pivot shaft 82 is such that the locking piece 76 is completely engaged with the lateral groove 74, the lock switch 230 is placed in lock (ON) state; and when the link 78 is moved from this position, the lock switch 230 is placed in non-lock (OFF) state.

Figure 6:
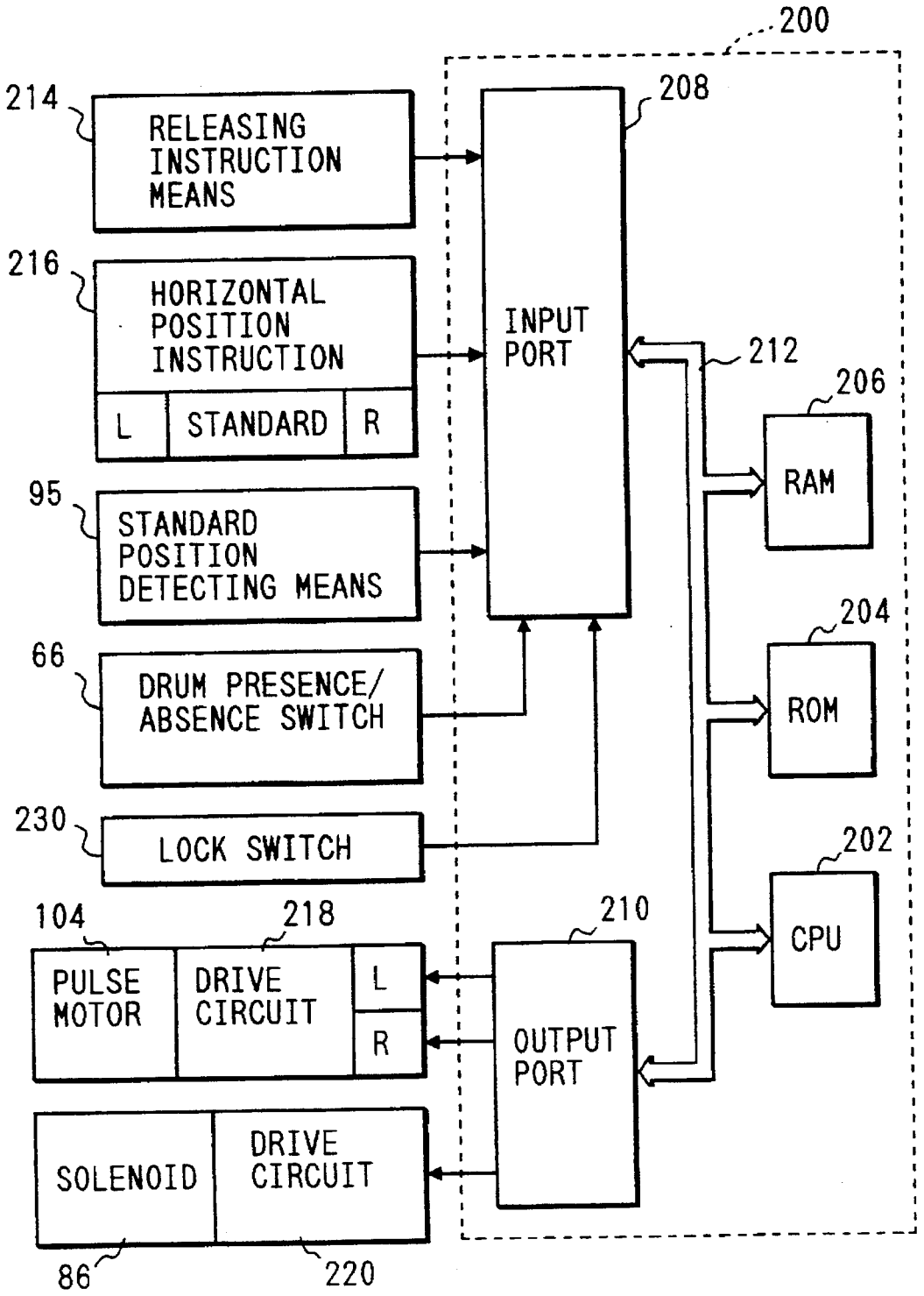
FIG. 6 is a block diagram outlining the arrangement of a control device for controlling the operations of the components of the machine which are shown in FIGS. 1 through 4.

FIG. 6 is a block diagram outlining the arrangement of a control device using a microcomputer for controlling tile operation of the stencil printing machine. The microcomputer 200 shown in FIG. 6 is a conventional one comprising a central processing unit (CPU) 202, a read-only memory (ROM) 204, a random access memory (RAM) 206, an input port 208, an output port 210, and a common bus 212 connected between those elements. The microcomputer 200 is provided for controlling the whole stencil printing machine. The input port 208 and the output port 210 are connected to a number of signal transmitting means and a number of signal receiving means in addition to those shown in FIG. 6; however, for simplification in illustration, FIG. 6 shows only those which concern print image position adjusting means and printing-drum position setting means. That is, the following signals are applied to the microcomputer 200 through the input port 208: One of the signals is an instruction signal which is outputted by releasing instruction means 214 which is for instance a push button. The releasing instruction means 214 is provided near the printing drum holding device 24 set in the printing machine; more specifically it is located at a suitable position inside the door of the printing machine which is opened to pull the printing drum holding device 24 out of the printing machine frame. The releasing instruction signal is produced when the releasing instruction means 214 is operated before the printing drum holding device 24 is pulled out. The releasing instruction signal thus produced is to release the printing drum holding device 24 from the operating position. In addition, horizontal position instruction means 216 provided on the control board of the stencil printing machine applies to the microcomputer a return instruction signal or a horizontal position instruction signal to set the printing drum holding device at the standard position relating to the printing machine frame or to shift it a predetermined distance to the right or left. In FIG. 6, R and L of the horizontal position instruction means 216 designate right and left, respectively. Moreover, the standard position detecting means 95 comprising the tongue piece 92 and the optical sensor 94 applies a standard position detection signal through the input port to the microcomputer which determines whether or not the horizontal position of the printing drum holding device with respect to the printing machine frame is the standard position. On the other hand, a pulse motor drive signal is outputted through the output port so that the pulse motor 104 is driven through the drive circuit 218 to move the printing drum holding device to the right or left with respect to the printing machine frame. In FIG. 6, R and L of the drive circuit 218 designate right and left, respectively. In addition, a solenoid drive signal is outputted through the output port so that the solenoid 86 is energized through the drive circuit 220 to move the locking piece 76 away from the annular groove 72 in the end portion of the engaging rod 58.

Figure 7:
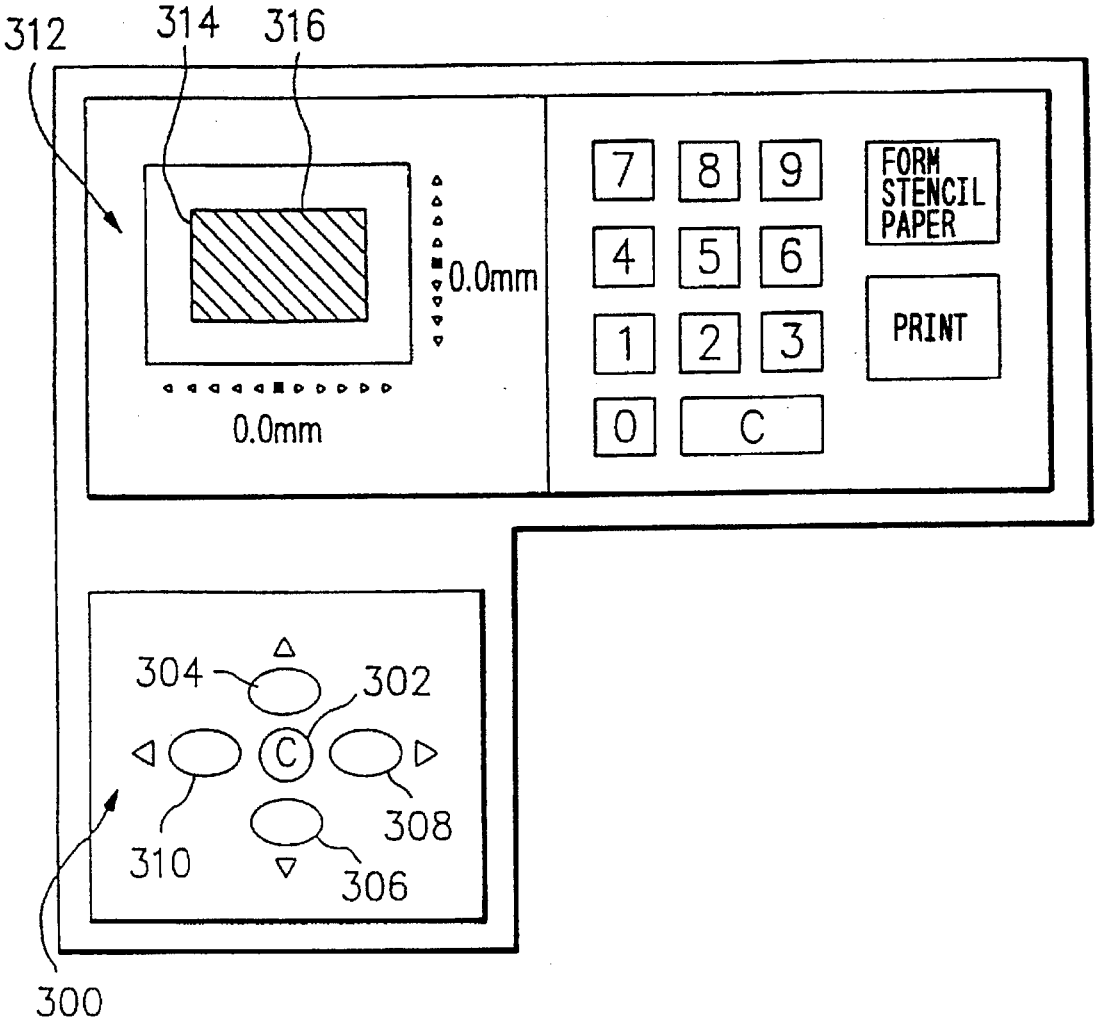
FIG. 7 is a front view outlining a control board.

FIG. 7 is a front view of a control board for generally controlling the operation of the stencil printing machine. The control board includes parts concerning the print image position adjusting means. In FIG. 7, what is generally indicated at 300 is print image position instruction means which includes horizontal position instruction means and vertical position instruction means. Further in FIG. 7, reference numeral 302 designates a print image position return instruction push button which, when pushed, provides an instruction to return the horizontal position of the printing drum holding device with respect to the printing machine frame to the standard position, and an instruction to return the vertical position of the print image which is provided by print image vertical position adjusting means to a standard position. Further in FIG. 7, reference numeral 304 designates a left shift instruction push button which, whenever operated, provides an instruction to shift the horizontal position of the printing drum holding device with respect to the printing machine frame as much as a predetermined distance to the left; and 306, a right shift instruction push button which, whenever operated, provides an instruction to shift the horizontal position of the printing drum holding device with respect to the printing machine frame as much as a predetermined distance to the right. Furthermore in FIG. 7, reference numeral 308 designates an upward shift instruction push button which, whenever operated, provides an instruction to shift the vertical position of the print image as much as a predetermined distance upwardly; and 310, a downward shift instruction push button which, whenever operated, provides an instruction to shift the vertical position of the print image as much as a predetermined distance downwardly.

Figure 8:
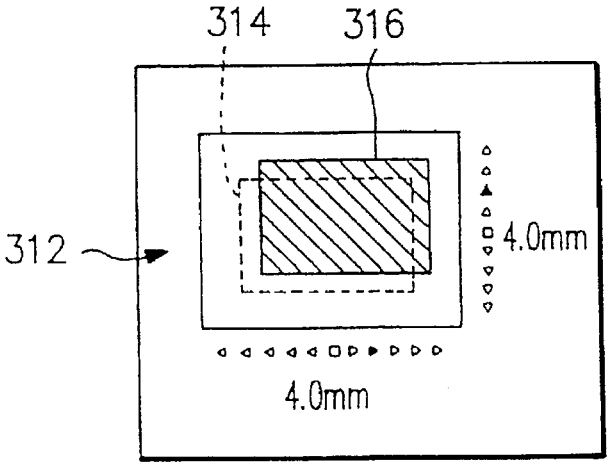
FIG. 8 is a diagram showing an example of a display made by print image position display means on the control board.

Further in FIG. 7, reference numeral 312 designates print image position displaying means which displays how much the print image is shifted from the standard position by the print image position adjusting means. The print image position displaying means 312 displays a rectangular standard print position display mark 314 which indicates both the horizontal position of the printing drum holding device with respect to the printing machine frame, and a standard position concerning the relative angular position of the printing drum and the lower pusher roller, and a rectangular shift print position display mark 316 which indicates both the amount of horizontal shift of the printing drum holding device from the standard position with respect to the printing machine frame which is effected by the print image position adjusting means and the print image vertical position adjusting means, and the amount of vertical shift from the relative rotational phase angle standard position of the printing drum and the lower pusher roller. FIG. 8 shows the shift print position display mark 316 shifted from the standard print position display mark 314, by way of example. In the case of FIG. 8, the printing drum holding device is shifted to the left of the standard position with respect to the printing machine frame, and the print image is shifted upwardly from the standard position through the adjustment of the relative rotational phase angle of the printing drum and the lower pusher roller by the print image vertical position adjusting means.

It is assumed that the printing machine is in ordinary state; that is, the printing drum supported by the printing drum holding device 24 is at the operating position in the printing machine frame 32, and the engaging rod 58 is axially coupled through the locking piece 76 with the socket 60. Under this condition, in order to remove the printing drum 10 from the printing machine frame 32 for maintenance or inspection, the releasing instruction means 214 is operated to output an releasing instruction. As a result, shift measuring means for measuring the amount of horizontal shift of the printing drum holding device 24 from the standard position with respect to the printing machine frame 32 is operated, while the pulse motor 104 is operated, so that the printing drum holding device 24 is moved towards the non-operating position with respect to the printing machine frame 32; i.e., in a printing-drum draw-out direction. The shift measuring means is made up of means provided in the microcomputer 200 for counting a pulse signal applied to the pulse motor 104, and the standard position detecting means 95 comprising the tongue piece 92 and the optical sensor 94. When the printing drum holding device thus moved reaches a predetermined final position, it is detected by the shift measuring means. As a result, the drive pulse current is applied to the pulse motor 104 in the opposite direction, so that the socket 60 is moved in the opposite direction (to the right in FIG. 1), and at the same time the solenoid 86 is energized to disengage the locking piece 76 from the angular groove 72. As was described above, when the driving force applied to the printing drum holding device 24 through the engaging rod 58 from the socket 60 is reversed in direction, the locking piece 76 is moved so as to disengage from the annular groove 72. Hence, the locking piece 76 is readily disengaged from the annular groove 72 even with a small driving force. Therefore, the operator can pull the printing drum 10 together with the printing drum holding device 24 out of the printing machine frame by pulling the printing drum holding device 24 forwardly with the draw-out handle When the printing drum holding device is pulled from the operating position to the draw-out position in the above-described manner, it is detected by the limit switch 66, so that the removal of the printing drum is displayed.

Even after the engaging rod 58 is released, the pulse motor is kept driven, so that the socket 60 is pulled back until the printing drum holding device is set at the standard position in the horizontal direction with respect to the printing machine frame. When the socket 60 reaches the standard position, the standard position detection means 95 made up of the tongue piece 92 and the optical sensor 94 detects it. As a result, the pulse motor 104 is stopped, the solenoid 86 is deenergized, and the locking piece 76 is returned to the locking position; that is, it is engaged with the lateral groove 74 by the elastic force of the tension coil spring 84. Thus, the machine has become ready for loading the printing drum holding device again.

When the printing drum holding device 24 which has been pulled out until the engaging rod 58 is disengaged from the socket, is pushed back to the original operation position again, the engaging rod 58 is inserted into the socket 60 which is at the standard position. The tapered end portion of the engaging rod 58 raises the end portion of the locking piece 76. When the annular groove 72 aligns with the lateral groove 74, the locking piece 76 is fitted in the annular groove 72. Now, the axial movement of the printing drum holding device 24 is controlled by the socket 60.

Thereafter, drive pulse current is applied to the pulse motor according to the adjust position at which the printing drum is located before pulled out and which is stored in the RAM 206 of the microcomputer 200, so that the printing drum is automatically returned to the adjust position (the operating position).

In response to the operation of a print image horizontal position instruction button 226 or 228 on the control board, the pulse motor 104 is turned in the forward direction or in the reverse direction from the position of rotation corresponding to the standard position, so that the threaded shaft 99 is turned, and the socket 60 is therefore moved axially. Accordingly the printing drum holding device 24 coupled to the socket 60 is moved along the central axis of the printing drum 10. In this operation, the amount of shift of the print image in the horizontal direction is indicated as the amount of shift of the shift print position display mark 316 from the standard print position display mark 314 in the print image position display means 312. For instance, the print image is shifted as much as 0.5 mm whenever the button 304 or 306 is depressed.

For simplification in illustration, in FIGS. 1 and 2, the middle portions of the printing drum 10 and the printing drum holding device 24 are not shown; that is, their axial lengths are shown shortened when compared with their radial lengths. In practice, the printing drum is long in the axial direction, being 2 to 2.5 in the ratio of length to diameter. In correspondence to the printing drum, the printing drum holding device 24 is also long in the axial direction. When moved, the printing drum holding device is guided by the pair of intermediate movable rails 26 and the pair of stationary rails 30 which are provided on both sides of the printing drum holding device 24 and in parallel with the direction of length of the printing drum holding device 24. Hence, no matter how a driving force is applied to the printing drum holding device 24, the printing drum holding device 24 is smoothly moved in the axial direction without being staggered. Especially in the case where, as was described above, the driving force is applied to the printing drum holding device 24 through the engaging rod 58 provided on the end face of the printing drum holding device 24, the printing drum holding device 24 is smoothly moved in the axial direction by the driving force applied to only one point on it. Furthermore, in the above-described embodiment, the engaging rod 58 through which the driving force is applied is provided near the central axis of the printing drum 10 or the printing drum holding device 24. Hence, the printing drum holding device is accurately and smoothly moved in the direction; that is, fine adjustment of the axial direction movement of the latter can be achieved with high accuracy.

A method of controlling the linkage drive section in the stencil printing machine (corresponding to a drum locking operation) will be described with reference to FIGS. 9A through 12. FIGS. 9A to 9D are explanatory diagrams showing positional relationships between the printing drum 10, the drum presence/absence switch 66 and the lock switch 230 in the stencil printing machine, and the arrangement of components provided around them. As shown in FIGS. 9A to 9D, the locking piece 76 is swingable about a shaft 76*a*. For simplification in illustration, the socket 60 on the side of the printing machine frame, which is coupled through the locking piece 76 to the locking rod 58, is not shown in FIGS. 9A to 9D.

Figure 9A:
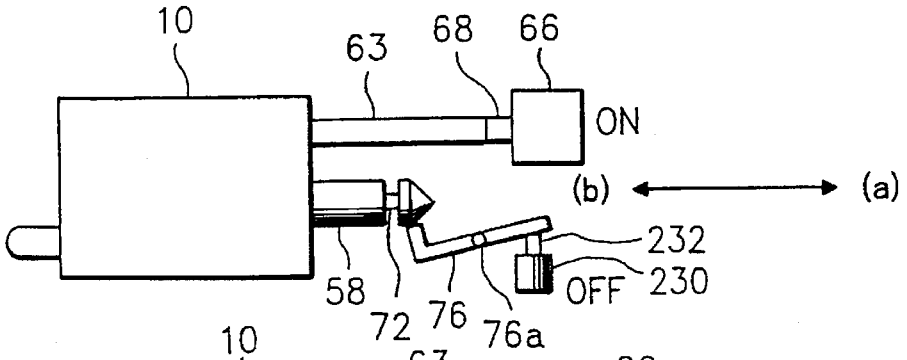
FIGS. 9A to 9D are explanatory diagrams for a description of the positional relationships between a printing drum, a drum presence/absence switch, and a lock switch.
Figure 9B:
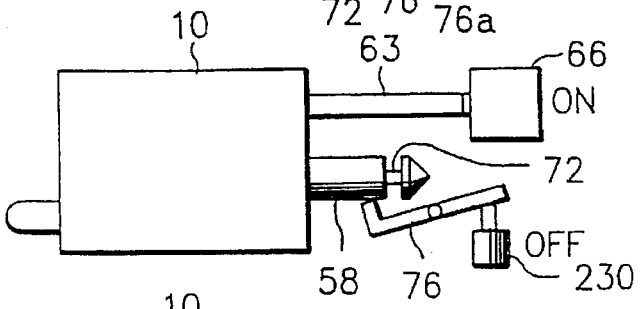
Figure 9C:
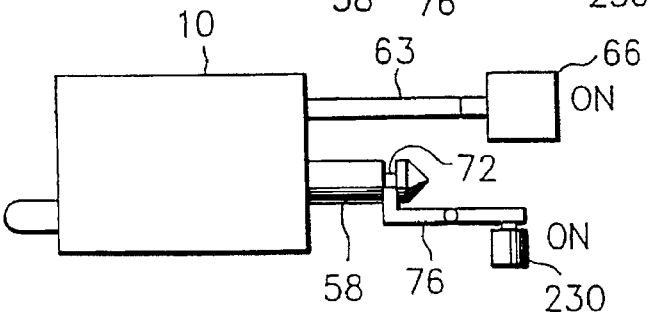
Figure 9D:
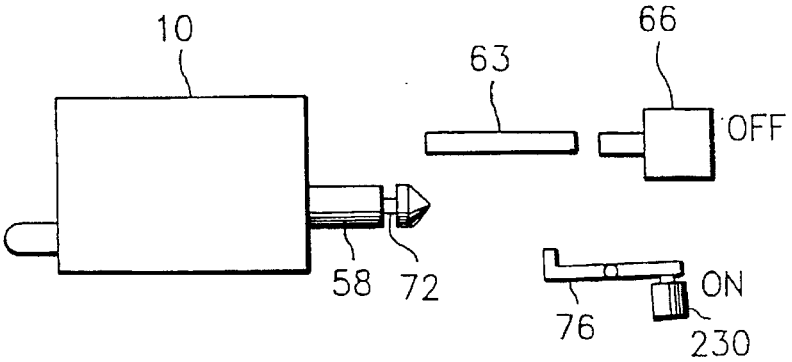
Figure 10:
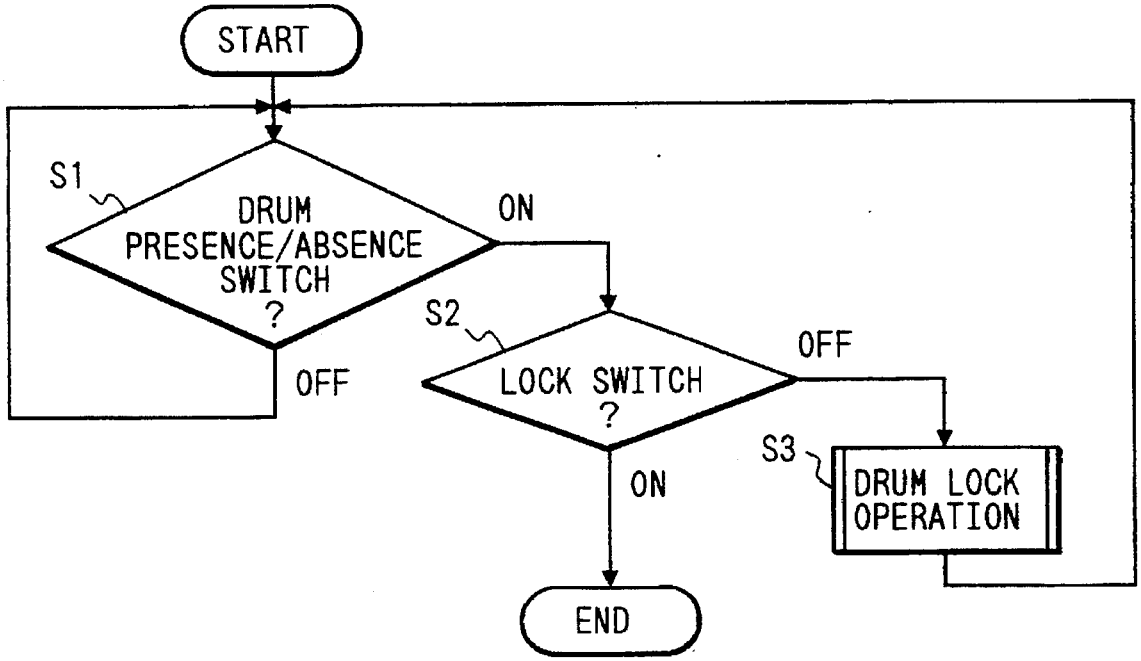
FIG. 10 is a flow chart for starting a drum locking operation in the stencil printing machine.

FIGS. 9A and 9B show the case in which the printing drum 10 is located near the operating position, and the drum presence/absence switch 66 is turned on, while the lock switch 230 is turned off, not being locked. FIG. 9C shows the case where the printing drum 10 is set accurately at the operating position, and both the drum presence/absence switch 66 and the lock switch 230 are turned on. FIG. 9D shows the case where the printing drum 10 is sufficiently away from the operating position, and the drum presence/absence switch 66 is turned off while the lock switch 230 is turned on, being locked (ON).

Under the condition shown in FIG. 9D, the printing drum 10 is pushed axially towards the operating position in the printing machine; that is, the printing drum 10 is pushed in the direction of the arrow (a). In the case where the printing drum 10 is correctly pushed in the printing machine, as shown in FIG. 9C the locking piece 76 is engaged with the annular groove 72 of the engaging rod 58 inserted into the socket (not shown), so that the printing drum 10 is coupled to the printing machine frame (which will be referred to as "drum locking state" when applicable).

However, sometimes the locking piece 76 is not engaged with the annular groove 72 as shown in FIG. 9A or 9B; that is, the printing drum 10 is not coupled to the printing machine frame. In order to overcome this difficulty, in the embodiment, whenever the printing drum 10 is pushed into the printing machine it is determined whether or not the printing drum 10 has been locked. That is, when it is determined that the printing drum 10 is not locked, the drum locking operation is carried out to correctly lock the printing drum 1.

Determination of the fact that the drum has been locked, and control of the drum locking operation are carried out by the microcomputer 200. That is, the microcomputer 200 operates according to a flow chart shown in FIG. 10. First, the microcomputer 200 determines whether or not the printing drum 10 has been locked, and then starts the drum locking operation if necessary.

When the drum presence/absence switch 66 is in drum presence state (ON) (Step S1), then it is detected whether or not the lock switch 230 is locked (Step S2). When it is determined that the lock switch 230 is not locked (OFF), the drum locking operation is started (Step S3). In Step S3, the initial state of the printing drum 10 is as shown in FIG. 9A or 9B.

Figure 11:
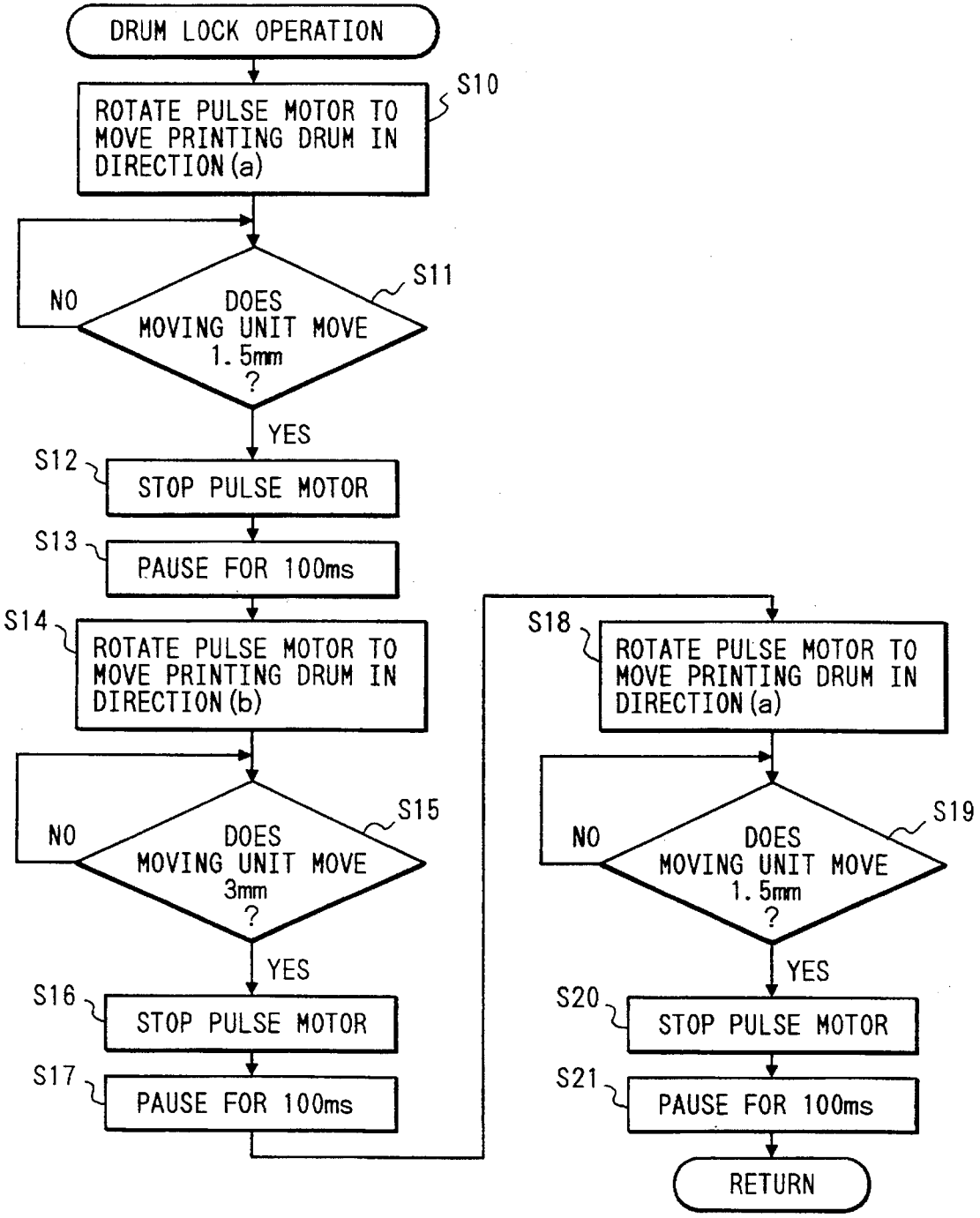
FIG. 11 is a flow chart for a description of the drum locking operation in the stencil printing machine.

The drum locking operation is carried out according to a flow chart shown in FIG. 11.

In Step S10, the pulse motor 104 is driven so that the locking piece 76 and the socket 60 integral with the locking piece 76 are moved in the direction of the arrow (a) in FIG. 9A (being moved away from the printing drum 10). Hereinafter, the locking piece 76 and the socket 60 integral with the former 76 will be referred to as "a moving unit", when applicable.

In Steps S11 and S12, when the moving unit is moved 1.5 mm in the direction of the arrow (a), the pulse motor 104 is stopped.

Thereafter, Step S13 is effected to provide a pausing period of 100 ms. Next, in Step S14, the pulse motor 104 is turned in the opposite direction, so that the moving unit is moved in the direction of the arrow (b) in FIG. 9A (being moved towards the printing drum). In Steps S15 and S16, when the moving unit is moved 3.0 mm in the direction of the arrow (b), the pulse motor 104 is stopped.

Thereafter, Step S17 is effected to provide a pausing period of 100 ms. Next, in Step S18, the pulse motor 104 is turned in the opposite direction, so that the moving unit is moved in the direction of the arrow (a) in FIG. 9A (being moved away from the printing drum 10. In Steps S19 and S20, when the moving unit is moved 1.5 mm in the direction of the arrow (a), the pulse motor 104 is stopped.

In the embodiment, the drum locking operation is ended when Steps S10 through S21 have been effected once. However, the machine may be so designed that the drum locking operation is ended when Steps S10 through S21 are effected three times, or when Steps S10 through S16 are effected once. In this case, the printing drum 10 has to be returned to the standard position by driving the pulse motor 104 after Step S16.

Figure 12:
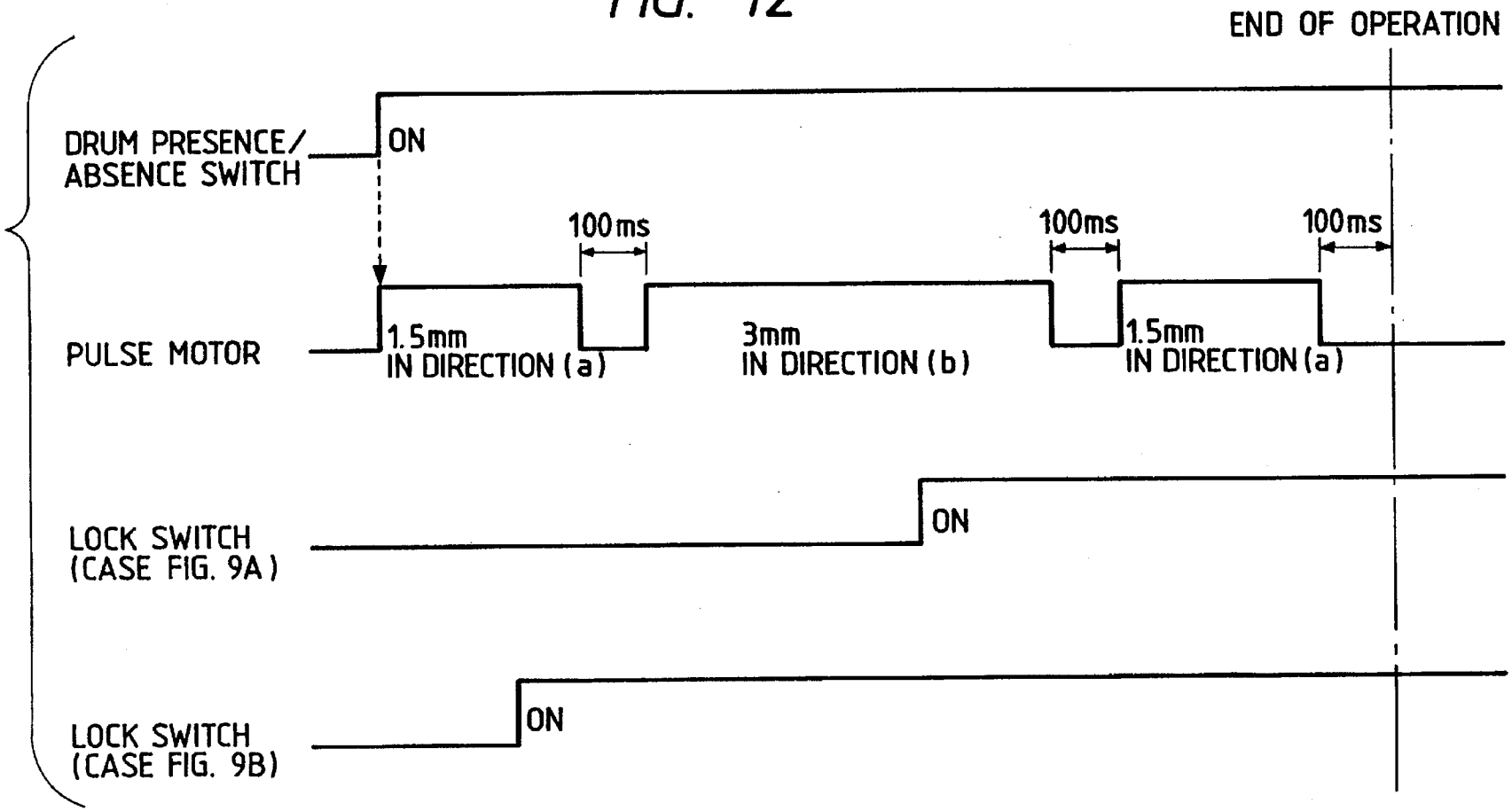
FIG. 12 is a time chart for a description of the control operation of a linkage drive section in the stencil printing machine.

FIG. 12 is a time chart for a description of the drum locking operations which are carried out according to the above-described procedure for the cases of FIGS. 9A and 9B. In each of the cases, the pulse motor 104 is driven to start the drum locking operation when the drum presence/absence switch 66 is turned on.

In the case of FIG. 9B, while the moving unit is moved 1.5 mm in the direction of the arrow (a) for the first time with the pulse motor 104 being driven, the lock switch 230 is turned on; that is, the printing drum 10 and the moving unit are locked as shown in FIG. 9C. Thereafter, the moving unit and the printing drum 10 are moved 3 mm in the direction of the arrow (b) and 1.5 mm in the direction of the arrow (a), so that the moving unit and the printing drum 10 are moved back to the standard positions where they were located before the drum locking operation.

In the case of FIG. 9A, while the moving unit is moved 1.5 mm in the direction of the arrow (a) by the pulse motor 104 for the first time, the lock switch 230 is not turned on. However, while the pulse motor 104, after pausing for 100 ms, is turned in the opposite direction to move the moving unit 3 mm in the direction of the arrow (b), the lock switch 230 is turned on. That is, the printing drum 10 and the moving unit are locked as shown in FIG. 9C. Thereafter, the pulse motor is turned in the opposite direction to return the moving unit and the printing drum 10 1.5 mm in the direction of the arrow (a). Hence, the moving unit and the printing drum 10 are returned to the standard positions where they were located before the drum locking operation.

As is apparent from the above description, even when the printing drum 10 is not correctly set at the standard position in the printing machine, the detection signals of the drum presence/absence switch 66 and the lock switch 230 are utilized to move the moving unit back and forth in the direction of the axis of the printing drum 10 to find the correct locking position for the printing drum 10. Hence, the printing drum 10 can be set at the standard position with high accuracy at all times.

Even when the printing drum supported by the printing drum holding device is not accurately set at the standard position in the printing machine, according to the control method of the invention the second coupling element is automatically coupled to the first coupling element, so that the printing drum is positively set at the standard position.

What is claimed is:

1. A stencil printing machine comprising:

a printing drum;

a printing machine frame;

a printing drum holding device which rotatably supports said printing drum, and which is suspended from said printing machine frame in such a manner that said device is movable along an axis of said printing drum to move said printing drum between an operating position in said printing machine and a draw-out position outside said printing machine;

print image position adjusting means for finely adjusting the position of said printing drum in the direction of the axis of said printing drum with respect to said printing machine frame, said print image position adjusting means having a first coupling element provided on the side of said printing drum holding device, a second coupling element provided on the side of said printing machine frame, and a linkage drive section provided on the side of said second coupling element for driving said second coupling element along the direction of the axis of said printing drum with respect to said printing machine frame, one of said first and second coupling elements having a lateral groove which is extended perpendicular to the direction of the axis of said printing drum, while the other being provided with a movable locking piece which is selectively engaged with said lateral groove to prevent the relative movement of said first and second coupling elements in the direction of the axis of said printing drum;

a first detector for detecting whether or not said printing drum is located near a standard position with respect to said printing machine frame when said printing drum is set in said printing machine frame;

a second detector for detecting whether or not said locking piece is engaged with said lateral groove; and a controller for controlling said linkage drive section such that said controller detects, in response to a signal from said first detector, whether or not said printing drum is located near a standard position with respect to said printing machine frame when said printing drum is set in said printing machine frame; detects, in response to a signal from said second detector, whether or not said locking piece is engaged with said lateral groove; moves said second coupling element a first distance in a first direction in parallel with the direction of the axis of said printing drum when said controller detects that said printing drum is located near said standard position and that said locking piece is not engaged with said lateral groove; and then, moves said second coupling element a second distance in a second direction opposite to said first direction.

2. A stencil printing machine according to claim 1, wherein said controller moves said second coupling element together with said printing drum after said locking piece is engaged with said lateral groove.

3. A controller for controlling a linkage drive section in a stencil printing machine, said stencil printing machine comprising: a printing drum; a printing machine frame; a printing drum holding device which rotatably supports said printing drum, and which is suspended from said printing machine frame in such a manner that said device is movable along an axis of said printing drum to move said printing drum between an operating position in said printing machine and a draw-out position outside said printing machine; and print image position adjusting means for finely adjusting the position of said printing drum in the direction of the axis of said printing drum with respect to said printing machine frame, said print image position adjusting means having a first coupling element provided on the side of said printing drum holding device, a second coupling element provided on the side of said printing machine frame, and said linkage drive section provided on the side of said second coupling element for driving said second coupling element along the direction of the axis of said printing drum with respect to said printing machine frame, one of said first and second coupling elements having a lateral groove which is extended perpendicular to the direction of the axis of said printing drum, while the other being provided with a movable locking piece which is selectively engaged with said lateral groove to prevent the relative movement of said first and second coupling elements in the direction of the axis of said printing drum, wherein said controller comprises:

a first detector for detecting whether or not said printing drum is located near a standard position with respect to said printing machine frame when said printing drum is set in said printing machine frame;

a second detector for detecting whether or not said locking piece is engaged with said lateral groove; and moving means for moving said second coupling element a first distance in a first direction in parallel with the direction of the axis of said printing drum when the controller detects that said printing drum is located near said standard position and that said locking piece is not engaged with said lateral groove, and then, moving said second coupling element a second distance in a second direction opposite to said first direction.

4. A controller according to claim 3, wherein said moving means of said controller moves said second coupling element together with said printing drum after said locking piece is engaged with said lateral groove.

* * * * *